US009870889B2

(12) United States Patent
Lueck et al.

(10) Patent No.: US 9,870,889 B2
(45) Date of Patent: Jan. 16, 2018

(54) CIRCUIT ARRANGEMENT FOR ACTUATING A BISTABLE RELAY

(71) Applicant: SMA Solar Technology AG, Niestetal (DE)

(72) Inventors: Matthias Lueck, Kassel (DE); Gerd Wollenhaupt, Kaufungen (DE)

(73) Assignee: SMA Solar Technology AG, Niestetal (DE)

( * ) Notice: Subject to any disclaimer, the term of this patent is extended or adjusted under 35 U.S.C. 154(b) by 412 days.

(21) Appl. No.: 14/625,725

(22) Filed: Feb. 19, 2015

(65) Prior Publication Data

US 2015/0162154 A1 Jun. 11, 2015

Related U.S. Application Data

(63) Continuation of application No. PCT/EP2013/067378, filed on Aug. 21, 2013.

(30) Foreign Application Priority Data

Aug. 29, 2012 (DE) ..... 10 2012 107 953

(51) Int. Cl.

| | |
|---|---|
| ***H01H 47/32*** | (2006.01) |
| ***H01H 47/22*** | (2006.01) |
| ***H01H 47/00*** | (2006.01) |
| ***H01H 50/44*** | (2006.01) |
| ***H01H 50/64*** | (2006.01) |

(52) U.S. Cl.

CPC ..... *H01H 47/325* (2013.01); *H01H 47/002* (2013.01); *H01H 47/226* (2013.01); *H01H 50/44* (2013.01); *H01H 50/64* (2013.01); *H01H 47/32* (2013.01)

(58) Field of Classification Search

CPC ..... H01H 47/325; H01H 47/226

See application file for complete search history.

(56) References Cited

U.S. PATENT DOCUMENTS

| | | | | |
|---|---|---|---|---|
| 4,257,081 | A | 3/1981 | Sauer et al. | |
| 4,533,972 | A | 8/1985 | Ohashi et al. | |
| 5,079,667 | A * | 1/1992 | Kasano | H01H 47/226 361/156 |
| 2006/0098376 | A1 * | 5/2006 | Satoh | H01H 47/325 361/152 |
| 2008/0204964 | A1 | 8/2008 | Huang | |

FOREIGN PATENT DOCUMENTS

| | | |
|---|---|---|
| JP | S5760632 A | 4/1982 |

OTHER PUBLICATIONS

International Search Report dated Dec. 3, 2013 for international application No. PCT/EP2013/067378.

* cited by examiner

*Primary Examiner* — Scott Bauer

(74) *Attorney, Agent, or Firm* — Eschweiler & Potashnik, LLC

(57) ABSTRACT

The disclosure relates to a circuit arrangement for actuating a bistable relay including a relay coil of the bistable relay being arranged in a series circuit with a capacitor, wherein the series circuit is connected to a supply voltage (V+) via a first semiconductor switch for switching on the bistable relay and is short-circuited through a second semiconductor switch for switching off the bistable relay. The circuit arrangement includes at least one voltage regulator configured to regulate the voltage present at the relay coil of the bistable relay such that a preset voltage is not exceeded.

11 Claims, 3 Drawing Sheets

CIRCUIT ARRANGEMENT FOR ACTUATING A BISTABLE RELAY

FIELD

The disclosure relates to a circuit arrangement for actuating a bistable relay, in which a coil of the bistable relay is arranged in a series circuit with a capacitor, wherein the series circuit is connected to a supply voltage via a first semiconductor switch for switching on the bistable relay and is short-circuited with the aid of a second semiconductor switch for switching off the relay.

BACKGROUND

Bistable relays are often used when both switching states, namely switched on and switched off, are assumed for a relatively long period of time. Instead of permanent energization of a coil of the relay in the case of a monostable relay, energization only for the duration of the switchover between the switching states is required in the case of the bistable relay. Within the scope of the disclosure, a relay is generally understood to mean an electromagnetically actuated switching apparatus, i.e. a low-power relay or a DC or AC contactor which is designed for relatively high powers.

In order that a bistable relay assumes a defined switching state on failure of the supply voltage, the bistable relay is often arranged in the series circuit with a capacitor. In the event of loss of supply voltage, the energy stored in the capacitor can be used to bring the relay into a defined switching state, generally into the switched-off state. An electrolytic capacitor is generally used as the capacitor. The circuit arrangement mentioned at the outset can in this case be suitable for a bistable relay in which switching-on or switching-off of the relay takes place via current inrushes of different polarity through an individual coil of the relay, referred to below as the relay coil, or for a bistable relay in which a separate relay coil is provided in each case for the switch-on and switch-off operations.

In order to actuate the relay, it is necessary in each case to apply a minimum voltage to the relay coil for a minimum period of time. Owing to the charging or discharging operation of the capacitor which is connected in series with the bistable relay, a voltage drop which is increasing or decreasing approximately exponentially is set across the relay coil during the course of switching. In order to achieve the situation whereby the minimum voltage provided for the switching operation is present at the relay coil even at the end of the specified minimum time for the current inrush, either a capacitor with a relatively high capacitance needs to be selected or the supply voltage needs to be selected to be so high that the voltage at the relay coil is still sufficiently high even after the preset switching time. A capacitor with a relatively high capacitance is not desirable for reasons of space and costs. Increasing supply voltage is disadvantageous because, under certain circumstances, at least at the beginning of the charging and discharging operation of the capacitor, an excessively high voltage is then present at the relay coil, as a result of which the life of the relay can be reduced.

The document DE 27 47 607 C2 discloses a circuit arrangement for actuating a bistable relay, in which a zener diode is used in order to fix a value of the supply voltage below which a switch-off operation takes place. However, as stated previously, a capacitor with a correspondingly high capacitance connected in series with the relay coil is required. Protection of the relay coil from upward fluctuations in the supply voltage is not discussed.

The document U.S. Pat. No. 4,533,972 also discloses a circuit arrangement for actuating a bistable relay in which a capacitor is provided in a series circuit with a relay coil. Voltage stabilization of the voltage which is applied to the series circuit is provided. In this way, the relay coil can be protected from fluctuations in the supply voltage, but a capacitor with a correspondingly high capacitance connected in series with the relay coil is required in this case too.

SUMMARY

The present disclosure includes providing a circuit arrangement of the type mentioned at the outset in which a capacitor with a relatively low capacitance in a series circuit with the coil of the bistable relay can be used and which is tolerant to a supply voltage of varying magnitude.

In a circuit arrangement of the type mentioned at the outset in accordance with the disclosure, at least one voltage regulator is provided, which regulates the voltage present at the relay coil of the bistable relay in such a way that it does not exceed a preset voltage.

By virtue of the fact that the voltage present at the relay coil is regulated in such a way that it does not exceed a preset voltage, the voltage present directly at the relay coil is limited. By virtue of the limitation of the voltage across the relay coil, correspondingly also a magnitude-limited current flows through the relay coil, owing to the provided internal resistance of the relay coil. Therefore, the current flow through the capacitor is also limited, since the current flow is largely provided by the current flowing through the relay coil. Owing to the limited current flow into the capacitor, the time constant during charging or discharging of the capacitor is likewise limited, as a result of which the duration of the current inrush through the relay coil is extended in comparison with a circuit arrangement without the at least one voltage regulator. Therefore, the current inrush through the relay coil for switching on or switching off the relay is firstly limited in terms of its voltage magnitude, with the result that damage to the relay coil is prevented, and secondly the duration of the current inrush for actuating the relay is extended given the same capacitance of the capacitor. By implication, the capacitance of the capacitor can be selected to be lower than in the case of a circuit arrangement without the at least one voltage regulator. The first and also the second semiconductor switches can in this case each be separate elements. Alternatively, it is possible to convert the function of the first and/or second semiconductor switches by switching elements of the at least one voltage regulator.

In advantageous configurations of the circuit arrangement, a first and/or second voltage regulator is/are provided, which each have an input, an output and a control terminal, wherein a voltage is set at the voltage-regulated output relative to the control terminal which has an absolute value which does not exceed a preset voltage, and wherein the input is connected to the first or second semiconductor switch and the output and the control terminal are each connected to an output terminal for the relay coil. In one embodiment, the first or second voltage regulator has in each case one series transistor, whose control input is connected in each case to the control terminal via a series circuit comprising a zener diode and a diode and is connected in each case to the input via a resistor. In one embodiment, the diode and the zener diode are connected back-to-back in series with one another within their series circuit. Furthermore, in one embodiment the series transistors of the first and second voltage regulators are of types which are complementary to one another, in particular NPN or PNP bipolar transistors or n-channel or p-channel MOSFETs. The mentioned embodiments represent uncomplicated and very suitable implementations for the voltage regulators.

BRIEF DESCRIPTION OF THE DRAWINGS

The disclosure will be explained in more detail below with reference to example embodiments with the aid of three figures, in which.

DETAILED DESCRIPTION

Figure 1:
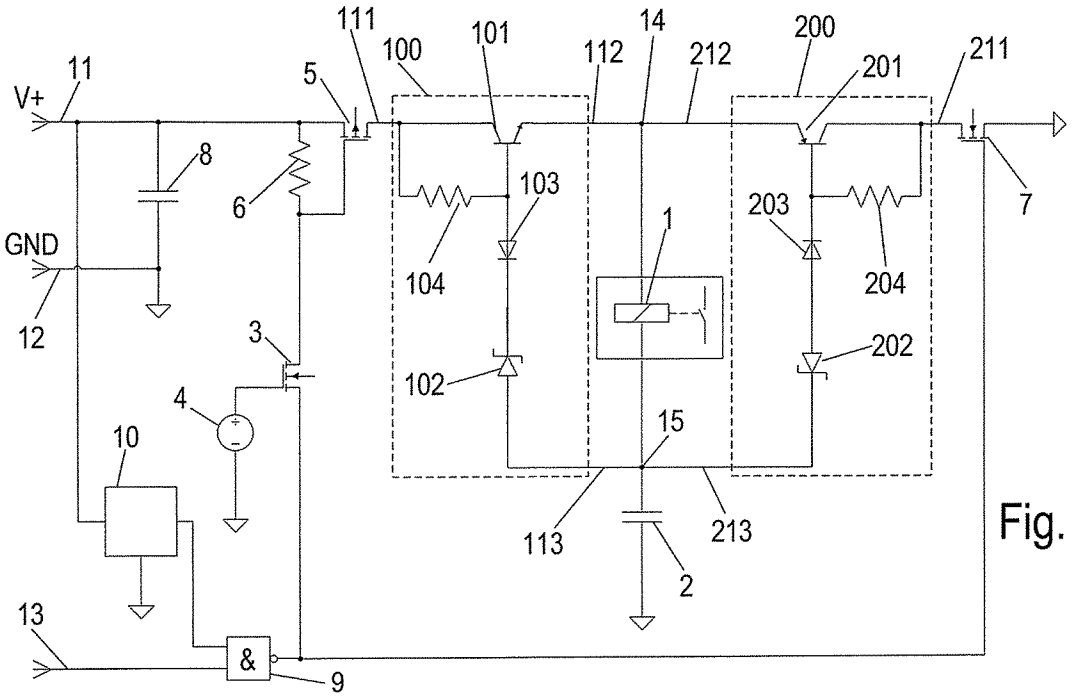
FIG. 1 shows a schematic circuit diagram of a first example embodiment of a circuit arrangement for actuating a bistable relay.

FIG. 1 shows a circuit arrangement for actuating a bistable relay in a first example embodiment in a schematic illustration.

The circuit arrangement has a terminal 11 for a positive supply voltage of V+, a terminal 12 (ground terminal; GND) and a control input 13. A smoothing capacitor 8 is arranged in parallel with the terminal 11 and the ground terminal 12. The bistable relay is connected with its coil 1, referred to below as relay coil 1, to the circuit arrangement via a first output terminal 14 and a second output terminal 15.

The relay switches depending on a level at the control input 13 and depending on whether at least a preset minimum voltage is applied to the terminal 11 for the supply voltage V+ with respect to the ground terminal 12.

In order to monitor the magnitude of the supply voltage V+, a discriminator 10 is provided, which outputs a logic signal at an output. If the magnitude of the supply voltage reaches or exceeds the minimum voltage, a signal with the logic level "1" is present at the output of the discriminator 10, otherwise there is a signal with the logic level "0". The output of the discriminator 10 is connected to input of a logic module 9, and the control input 13 is connected to a further input of this logic module 9. The logic module 9 is in the form of a NAND gate, with the result that a signal of logic "0" is only present at its output when both inputs are at logic "1".

In the example embodiment illustrated, the relay switches on (is set) when a signal of logic "0" is present at the output of the logic module 9. In the case of a signal of logic "1" at the output of the logic module 9, the bistable relay switches off (is reset). The relay is therefore set when both a supply voltage V+ of sufficient magnitude (greater than or equal to the minimum voltage) is present and a logic level of logic "1" is applied to the control input 13. In other cases, i.e. when the supply voltage V+ is below the minimum voltage and/or the control input 13 has a logic level of logic "0", the relay is reset. It goes without saying, however, that a reverse switching logic can also be realized. Provision can be made for the logic signals to assume levels in accordance with TTL logic. Furthermore, voltage values of other conventional logic levels, such as, for example, LVTTL, CMOS 1.8V, CMOS 2.5V or CMOS 5V, for actuating the relay at the control input 13 are also possible.

The relay coil 1 is connected in series with a capacitor 2. The capacitor 2 is in this case arranged between the second output terminal 15 and the ground terminal 12.

The first output terminal 14 is connected to the terminal 11 for the positive supply voltage V+ via a first voltage regulator 100 and a first semiconductor switch 5. The first semiconductor switch 5 in this example embodiment is in the form of a MOSFET (Metal-Oxide Semiconductor Field-Effect Transistor), whose control input (gate terminal) is likewise connected to the terminal 11 for the positive supply voltage V+ via a resistor 6. Furthermore, the gate terminal of the first semiconductor switch 5 is connected to the output of the logic module 9 via the switching path of a further semiconductor switch 3, in this case likewise a MOSFET. The control terminal (gate terminal) of the further semiconductor switch 3 is held at a preset potential with respect to the ground potential GND with a reference voltage source 4. The preset potential is selected such that the semiconductor switch 3 is off when there is a logic level of logic "1" at the output of the logic module 9 and is on when there is a logic level of logic "0".

In the case of a potential of logic "0" at the output of the logic module 9, the further semiconductor switch 3 correspondingly turns on and thus the first semiconductor switch 5 also turns on.

The first voltage regulator 100 is arranged between the first semiconductor switch 5 and the first output terminal 14, to which the relay coil 1 is connected. Said first voltage regulator has an input 111, with which it is connected to the first semiconductor switch 5, and an output 112, with which it is connected to the relay coil 1 via the first output terminal 14. In addition, it has a regulation input 113, with which it is connected likewise to the relay coil 1 via the second output terminal 15. The first voltage regulator 100 is in the form of a series regulator, comprising a series transistor 101, which is arranged with its switching path between the input 111 and the output 112. In this case, the series transistor 101 is an NPN bipolar transistor. The control input (base) of the series transistor 101 is connected to the input 111 via a resistor 104 and to the regulation input 113 via a series circuit comprising a zener diode 102 and a diode 103.

In the case of a level of logic "0" at the output of the logic module 9 and a correspondingly on first semiconductor switch 5, the positive supply voltage potential V+ is present at the input 111 of the first voltage regulator 100. Correspondingly, the series transistor 101 of the first voltage regulator 100 is turned on and a positive potential is applied to the first output terminal 14 for the relay coil 1.

In an alternative configuration of the circuit arrangement, the function of the first semiconductor switch 5 can also be taken over by the voltage regulator 100, specifically by a semiconductor switch of the voltage regulator 100, in particular the series transistor 101. It is possible, for example, to connect the control input of the series transistor 101 to the output of the logic module 9 and to actuate said control input in such a way that the series transistor 101 is only turned on and used for regulation when the output of the logic module 9 has a level of logic "0". The actuation of the series transistor can possibly take place via further switching elements, for example diodes and/or one or more low-power transistors, in order to combine the switching function with the regulation function. In this alternative configuration of the circuit arrangement, advantageously one of the transistors conducting the current through the relay coil 1 can be dispensed with.

The first output terminal 14 for the relay coil 1 is furthermore connected to ground potential GND via a second voltage regulator 200 and a second semiconductor switch 7. The second voltage regulator 200 likewise has a series transistor 201, whose switching path runs from an input 211 of the second voltage regulator 200 to an output 212, which is connected to the first output terminal 14 for the relay coil 1. A regulation input 213 is connected to the second output terminal 15 for the relay coil 1. The second voltage regulator 200 is constructed with mirror-image symmetry with respect to the first voltage regulator 100 and is designed to regulate an output voltage, which is negative with respect to the control terminal 213, at the output 212 in terms of its magnitude. Correspondingly, a PNP transistor which is complementary to the series transistor 101 is used as series transistor 201. The second semiconductor switch 7 is in this case a MOSFET, whose control input (gate terminal) is connected to the output of the logic module 9 of the circuit arrangement. By way of summary, therefore, the voltage present at the relay coil 1 is regulated by the first and second voltage regulators 100, 200 in such a way that its absolute value does not exceed a preset voltage.

In the case of a potential of logic "0" at the output of the logic module 9, the second semiconductor switch 7 is opened and, correspondingly, the series transistor 201 of the second voltage regulator 200 is not on. For the further consideration of the operations in the case of a potential of logic "0" at the output of the logic module 9 (this corresponds to a potential of logic "1" at the control input 13 and an applied supply voltage V+ which is greater than or equal to the minimum voltage), therefore, the second voltage regulator 200 can remain out of consideration.

Correspondingly, owing to the switched first semiconductor switch 5 and the on series transistor 101 of the first voltage regulator 100, a current flow flows through the relay coil 1 and the capacitor 2, by means of which firstly the relay switches on and secondly the capacitor 2 is charged. In this case, the voltage present between the first and second output terminals 14, 15 and therefore the voltage present directly at the relay coil 1 is regulated by the first voltage regulator 100 in such a way that it does not exceed a voltage preset by the zener diode 102 and the diode 103. By limiting the voltage across the relay coil 1, a current with limited magnitude correspondingly also flows through the relay coil 1, owing to the provided internal resistance of the relay coil 1. Correspondingly, the current flow through the capacitor 2 is also limited since this current flow is predominantly provided by the current flowing through the relay coil 1. The limited current flow into the capacitor 2 in these situations results in a deviation from the exponential charging characteristic up to delayed or current-limited charging of the capacitor 2. This results in a relatively large "effective time constant" when averaged over the charging time of the capacitor 2, as a result of which the duration of the current inrush through the relay coil 1 is extended in comparison with a circuit arrangement without the first voltage regulator. The current inrush through the relay coil 1 for switching on the relay is thus firstly limited in terms of its voltage magnitude, with the result that damage to the relay coil 1 is prevented, and secondly the duration of the current inrush for switching on the relay is extended given the same capacitance of the capacitor. By implication, the capacitance of the capacitor 2 can be selected to be smaller than in the case of a circuit arrangement without the first voltage regulator 100. The diode 203 of the second voltage regulator 200 in this case prevents a current flow via the regulation input 213 of the second voltage regulator 200.

The text which follows discusses the case in which either the supply voltage V+ decreases in terms of its magnitude to below the minimum voltage or the control input 13 has a logic level of logic "0". In both cases, the output of the logic module 9 is set to the level logic "1". It is assumed that the logic module 9 is buffered with respect to its power supply such that a level of logic "1" can be maintained at least for a certain time span.

In the case of a level of logic "1" at the output of the logic module 9, whose voltage level is greater than that of the reference voltage source 4, the further semiconductor switch 3 and the first semiconductor switch 5 turn off. Instead, however, the second semiconductor switch 7 is turned on and therefore also the series transistor 201 of the second voltage regulator 200 is turned on. The capacitor 2 has been charged virtually to the value of the supply voltage V+ owing to the switching operation which has previously taken place (i.e. which corresponds to the level at the output of the logic module 9 of logic "0"). The charge stored in the capacitor 2 is now discharged correspondingly via the second voltage regulator 200 and the relay coil 1. In turn, the diode 103 of the first voltage regulator 100 prevents a current flow via the control terminal 113 from the capacitor 2 from taking place.

The current inrush flowing through the relay coil 1 is of reverse polarity to that during switch-on of the relay and said relay correspondingly switches off. In turn, similarly to the case for switch-on, the voltage present at the relay coil 1 is limited, now by the second voltage regulator 200, so that a maximum voltage at the relay coil 1 is not exceeded, the current inrush is limited in terms of the magnitude of the current and is extended in terms of its duration correspondingly. By virtue of the second voltage regulator 200, therefore, the same advantages are achieved for the switch-on operation of the relay as for the switch-off operation by means of the first voltage regulator 100.

In an alternative configuration, the series transistor 201 of the second voltage regulator 200 can be connected to the ground terminal 12 directly and not via the second semiconductor switch 7, wherein the resistor 204 used in the voltage divider at the base of the series transistor 201 continues to be connected to the ground terminal 12 via the second semiconductor switch 7, however. Similarly to the alternative configuration in which the function of the first semiconductor switch 5 is taken over by the series transistor 101 of the first voltage regulator 100, it is also possible for the function of the second semiconductor switch 7 to be taken over by the second series transistor 201 of the second voltage regulator 200 with corresponding driving.

Figure 2:
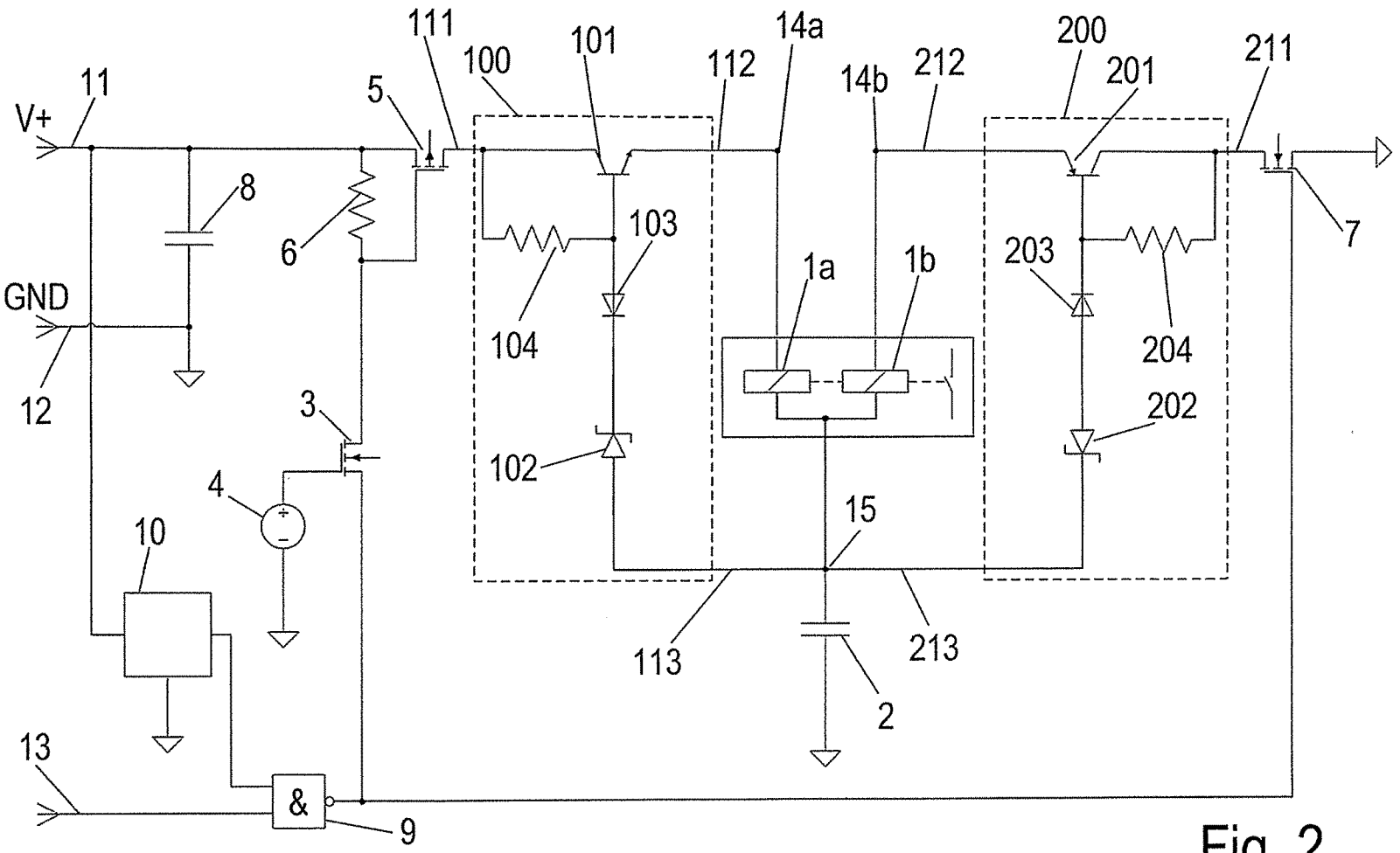
FIG. 2 shows a schematic circuit diagram of the circuit arrangement of the first example embodiment in an alternative configuration.

FIG. 2 shows an alternative configuration of the circuit arrangement shown in FIG. 1. In contrast to the example shown in FIG. 1, the present circuit arrangement is suitable for actuating a bistable relay comprising two relay coils 1*a*, 1*b*. The relay is set in the case of a current inrush through a first of the two relay coils, by way of example the relay coil 1*a*, and is reset in the case of a current inrush through the second of the two relay coils, for example the relay coil 1*b*.

The two relay coils 1*a*, 1*b* are connected with one of their terminals jointly to the second output terminal 15 of the circuit arrangement. The other terminal of the first relay coil 1*a* is connected to the output 112 of the first voltage regulator 100, and the other terminal of the second relay coil 1*b* is connected to the output 212 of the second voltage regulator 200. The two terminals 112, 212 are not directly connected to one another; correspondingly, two first output terminals 14*a*, 14*b* are provided in order to connect the relay coils 1*a*, 1*b* to the circuit arrangement.

With respect to function, reference is made to the details given in respect of FIG. 1. A current inrush for setting the relay is supplied to the relay coil 1*a*, and a current inrush is supplied to the relay coil 1*b* for resetting. As in the example in FIG. 1, the voltage present in this case at the relay coils 1*a*, 1*b* is limited in terms of its magnitude both during setting and resetting by the voltage regulators 100 and 200, respectively.

Figure 3:
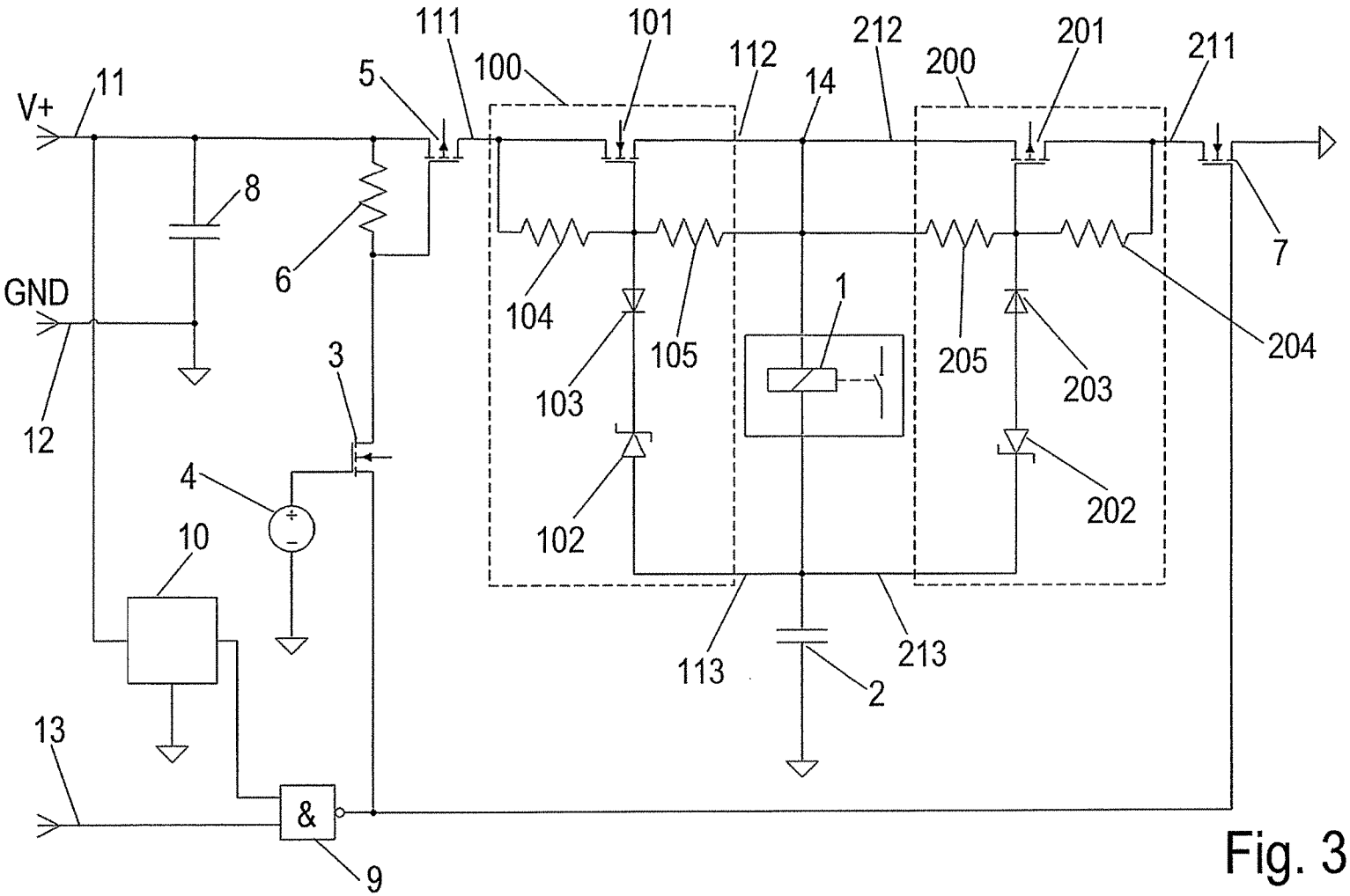
FIG. 3 shows a schematic circuit diagram of a second example embodiment of a circuit arrangement for actuating a bistable relay.

FIG. 3 shows a second example embodiment of a circuit arrangement for actuating a bistable relay. The same reference symbols in this example embodiment denote identical or functionally identical elements as in the first example embodiment.

The circuit in the second example embodiment substantially corresponds to that in the first example embodiment, the description of which is hereby incorporated by reference. In contrast to the circuit arrangement illustrated in FIG. 1, MOSFETs are in this case also used as series transistors 101 and 201 for the first and second voltage regulators 100, 200. In turn, complementary series transistors 101, 201 are used, in this case an n-channel MOSFET as series transistor 101 of the first voltage regulator 100 and a p-channel MOSFET as series transistor 201 of the second voltage regulator 200.

In order to ensure that the series transistor 201 of the second voltage regulator 200 turns off during the switch-on operation of the relay or the series transistor 101 of the first voltage regulator 100 turns off during the switch-off operation of the relay, resistors 105, 205 emerging from the first output terminal 14 are each connected to the control input (gate terminal) of the series transistors 101, 201. These resistors can have a very high resistance and do not influence the remaining functionality of the circuit arrangement. Possibly, depending on the type of MOSFET used for the series transistors 101, 201 and owing to the high resistance inherently always present there between the gate and source terminals, the resistors 105, 205 can be dispensed with even when using MOSFET transistors as series transistors 101, 201.

The invention claimed is:

1. A circuit arrangement for actuating a bistable relay, comprising:

a relay coil of the bistable relay arranged in a series circuit with a capacitor, wherein the series circuit is connected to a supply voltage via a first semiconductor switch for switching on the bistable relay and is short-circuited through a second semiconductor switch for switching off the bistable relay;

at least one voltage regulator, configured to regulate a voltage present at the relay coil of the bistable relay such that a preset voltage at the relay coil is not exceeded, comprising a first voltage regulator with a first input terminal, a first output terminal and a first control terminal, wherein the voltage is present at the first output terminal relative to the first control terminal with an absolute value below the preset voltage, wherein the first input terminal is connected to the first semiconductor switch, and wherein the first output terminal is connected to a first output terminal of the relay coil and wherein the first control terminal is connected to a second output terminal of the relay coil.

2. The circuit arrangement as claimed in claim 1, wherein the first voltage regulator comprises a series transistor, a control input of the series transistor being connected to the first control terminal via a first series circuit comprising a zener diode and a diode and being connected to the first input terminal via a resistor.

3. The circuit arrangement as claimed in claim 2, wherein the diode and the zener diode are connected back-to-back in series with one another within the first series circuit.

4. The circuit arrangement as claimed in claim 1, wherein the at least one voltage regulator comprises a second voltage regulator with a second input terminal, a second output terminal and a second control terminal, wherein the voltage is present at the second output terminal relative to the second control terminal with the absolute value below the preset voltage, wherein the second input terminal is connected to a ground terminal, and wherein the second output terminal is connected to the first output terminal of the relay coil, and wherein the second control terminal is connected to the second output terminal of the relay coil.

5. The circuit arrangement as claimed in claim 4, wherein the second voltage regulator comprises a further series transistor, a control input of the further series transistor being connected to the second control terminal via a second series circuit comprising a zener diode and a diode, and being connected to the second input terminal via a resistor, wherein the second input terminal is connected to the ground terminal via the second semiconductor switch.

6. The circuit arrangement as claimed in claim 4, wherein the second voltage regulator comprises a further series transistor, a control input of the further series transistor being connected to the second control terminal via a second series circuit comprising a zener diode and a diode, and being connected to the second semiconductor switch via a resistor.

7. The circuit arrangement as claimed in claim 5, wherein the diode and the zener diode are connected back-to-back in series with one another within the second series circuit.

8. The circuit arrangement as claimed in claim 5, wherein an anode of the zener diode of the first voltage regulator is connected to a cathode of the zener diode of the second voltage regulator via the second output terminal of the relay coil.

9. The circuit arrangement as claimed in claim 5, wherein a cathode of the diode of the first voltage regulator is coupled to an anode of the diode of the second voltage regulator via the second output terminal of the relay coil.

10. The circuit arrangement as claimed in claim 5, wherein the series transistor of the first voltage regulator and the further series transistor of the second voltage regulator are of complementary types to one another, in particular NPN or PNP bipolar transistors or n-channel or p-channel MOSFETs.

11. The circuit arrangement as claimed in claim 1, wherein the first semiconductor switch and the second semiconductor switch are connected to a control input of the circuit arrangement in such a way that they are on or off inversely with respect to one another depending on an input level at the control input.

* * * * *